US006338459B1

(12) United States Patent
Biggs

(10) Patent No.: US 6,338,459 B1
(45) Date of Patent: Jan. 15, 2002

(54) PAINT BUCKET HOLDER FOR A LADDER

(76) Inventor: Robert L. Biggs, 1940 River St. SW., Supply, NC (US) 28462

( * ) Notice: Subject to any disclaimer, the term of this patent is extended or adjusted under 35 U.S.C. 154(b) by 0 days.

(21) Appl. No.: 09/591,066

(22) Filed: Jun. 9, 2000

(51) Int. Cl.[7] ..... E06C 7/14
(52) U.S. Cl. ..... 248/210; 182/129; 248/311.2
(58) Field of Search ..... 182/129; 248/210, 248/211, 238, 311.2

(56) References Cited

U.S. PATENT DOCUMENTS

| | | | | | |
|---|---|---|---|---|---|
| 1,114,921 | A | * | 10/1914 | Selstad | 248/210 |
| 1,255,696 | A | * | 2/1918 | Bochard | 248/210 |
| 3,131,900 | A | * | 5/1964 | Anderson | 248/210 |
| 4,776,550 | A | | 10/1988 | Storey | |
| 4,824,060 | A | | 4/1989 | Korda | |
| D304,084 | S | | 10/1989 | Meng | |
| 5,106,045 | A | | 4/1992 | Bezotte | |
| 5,305,977 | A | | 4/1994 | Roth | |
| 5,651,523 | A | * | 7/1997 | Bridges | 248/311.2 |
| 5,687,941 | A | | 11/1997 | Quintile | |
| 5,873,433 | A | * | 2/1999 | Katz | 248/210 |

* cited by examiner

*Primary Examiner*—Alvin Chin-Shue

(57) ABSTRACT

A paint bucket holder for a ladder for supporting either a gallon or a quart of paint upon a ladder. The paint bucket holder for a ladder includes a clamping member being adapted to securely fasten to a rail of a ladder; and also includes an arm member having a first end and a second end which is securely attached to the clamping member; and further includes an adjustable holder support member being securely attached to the first end of the arm member and including a housing; and also includes a bucket holder member being movably mounted to the adjustable holder support member.

18 Claims, 3 Drawing Sheets

PAINT BUCKET HOLDER FOR A LADDER

BACKGROUND OF THE INVENTION

1. Field of the Invention

The present invention relates to a ladder paint bucket holder and more particularly pertains to a new paint bucket holder for a ladder for supporting either a gallon or a quart of paint upon a ladder.

2. Description of the Prior Art

The use of a ladder paint bucket holder is known in the prior art. More specifically, a ladder paint bucket holder heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,106,045; 4,824,060; 4,776,550; 5,305,977; 5,687,941; U.S. Pat. No. Des. 304,084.

While these devices fulfill their respective, particular objectives and requirements, the aforementioned patents do not disclose a new paint bucket holder for a ladder. The inventive device includes a clamping member being adapted to securely fasten to a rail of a ladder; and also includes an arm member having a first end and a second end which is securely attached to the clamping member; and further includes an adjustable holder support member being securely attached to the first end of the arm member and including a housing; and also includes a bucket holder member being movably mounted to the adjustable holder support member.

In these respects, the paint bucket holder for a ladder according to the present invention substantially departs from the conventional concepts and designs of the prior art, and in so doing provides an apparatus primarily developed for the purpose of supporting either a gallon or a quart of paint upon a ladder.

SUMMARY OF THE INVENTION

In view of the foregoing disadvantages inherent in the known types of ladder paint bucket holder now present in the prior art, the present invention provides a new paint bucket holder for a ladder construction wherein the same can be utilized for supporting either a gallon or a quart of paint upon a ladder.

The general purpose of the present invention, which will be described subsequently in greater detail, is to provide a new paint bucket holder for a ladder which has many of the advantages of the ladder paint bucket holder mentioned heretofore and many novel features that result in a new paint bucket holder for a ladder which is not anticipated, rendered obvious, suggested, or even implied by any of the prior art ladder paint bucket holder, either alone or in any combination thereof.

To attain this, the present invention generally comprises a clamping member being adapted to securely fasten to a rail of a ladder; and also includes an arm member having a first end and a second end which is securely attached to the clamping member; and further includes an adjustable holder support member being securely attached to the first end of the arm member and including a housing; and also includes a bucket holder member being movably mounted to the adjustable holder support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paint bucket holder for a ladder which has many of the advantages of the ladder paint bucket holder mentioned heretofore and many novel features that result in a new paint bucket holder for a ladder which is not anticipated, rendered obvious, suggested, or even implied by any of the prior art ladder paint bucket holder, either alone or in any combination thereof.

It is another object of the present invention to provide a new paint bucket holder for a ladder which may be easily and efficiently manufactured and marketed.

It is a further object of the present invention to provide a new paint bucket holder for a ladder which is of a durable and reliable construction.

An even further object of the present invention is to provide a new paint bucket holder for a ladder which is susceptible of a low cost of manufacture with regard to both materials and labor, and which accordingly is then susceptible of low prices of sale to the consuming public, thereby making such paint bucket holder for a ladder economically available to the buying public.

Still yet another object of the present invention is to provide a new paint bucket holder for a ladder which provides in the apparatuses and methods of the prior art some of the advantages thereof, while simultaneously overcoming some of the disadvantages normally associated therewith.

Still another object of the present invention is to provide a new paint bucket holder for a ladder for supporting either a gallon or a quart of paint upon a ladder.

Yet another object of the present invention is to provide a new paint bucket holder for a ladder which includes a clamping member being adapted to securely fasten to a rail of a ladder; and also includes an arm member having a first end and a second end which is securely attached to the clamping member; and further includes an adjustable holder support member being securely attached to the first end of the arm member and including a housing; and also includes a bucket holder member being movably mounted to the adjustable holder support member.

Still yet another object of the present invention is to provide a new paint bucket holder for a ladder that easily and conveniently clamps to a ladder for the user to have easy access to paint while being upon the ladder.

Even still another object of the present invention is to provide a new paint bucket holder for a ladder that can be used to securely support gallon and quart paint buckets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
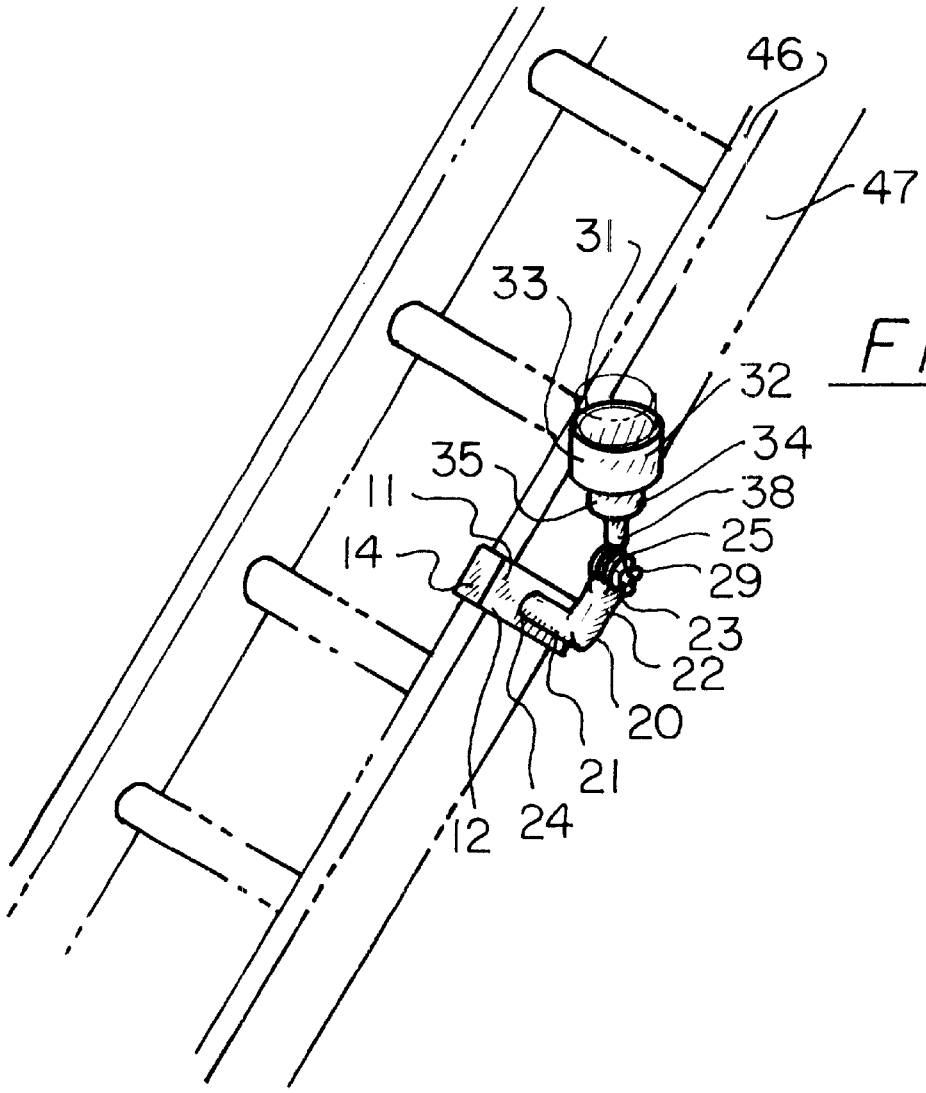
FIG. 1 is a perspective view of a new paint bucket holder for a ladder according to the present invention shown in use.
Figure 2:
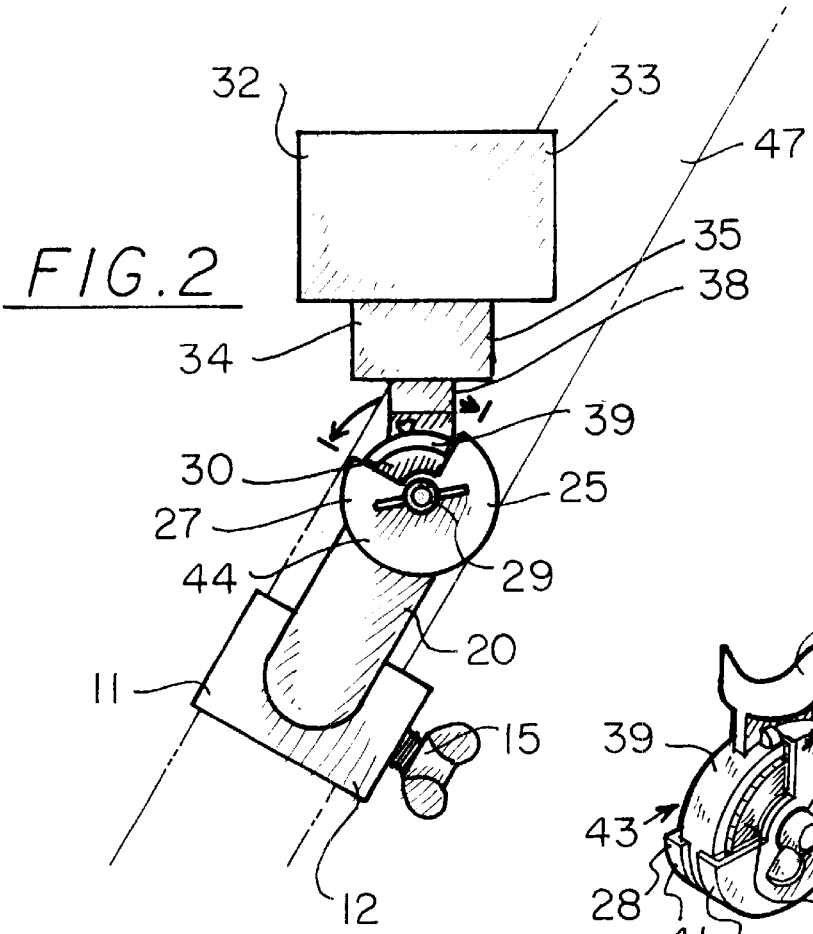
FIG. 2 is a side elevational view of the present invention shown in use.
Figure 3:
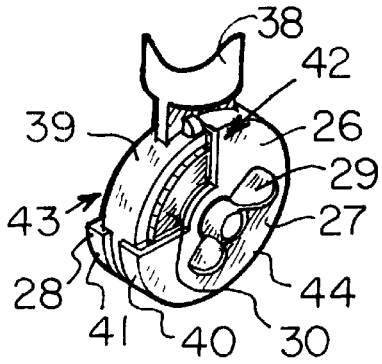
FIG. 3 is a detailed perspective view of the holder support member of the present invention.
Figure 4:
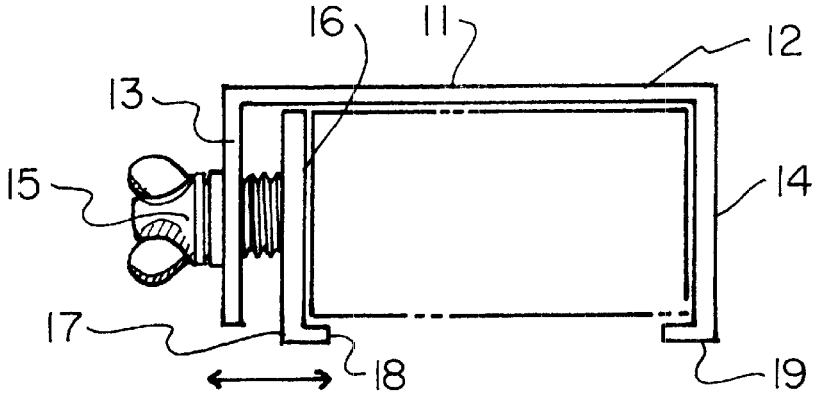
FIG. 4 is a side elevational view of the clamping member of the present invention.
Figure 6:
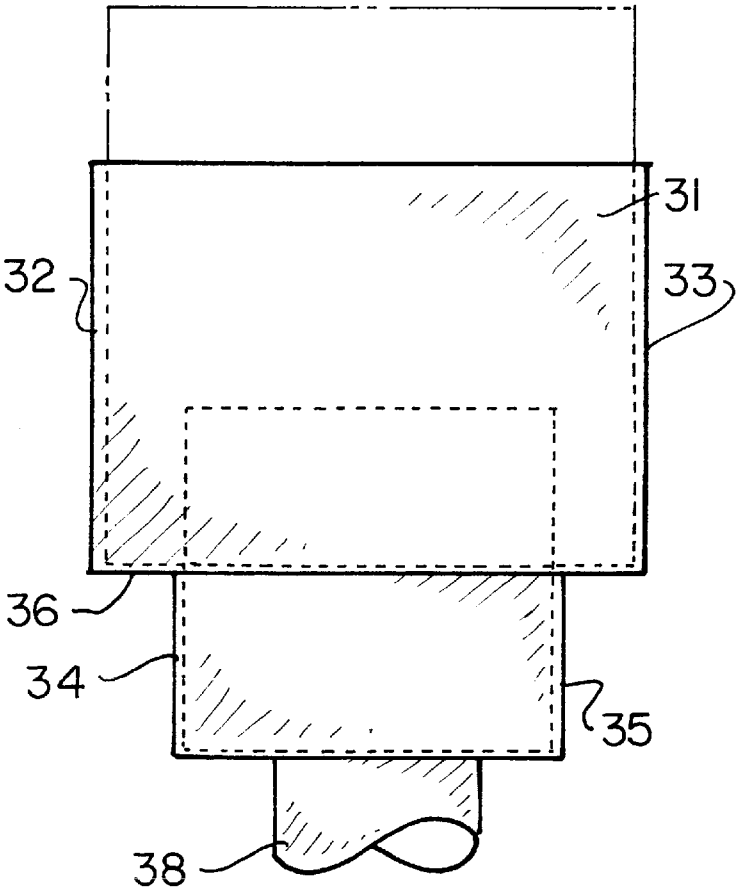
FIG. 6 is a side elevational view of the bucket holder member of the present invention.
Figure 5:
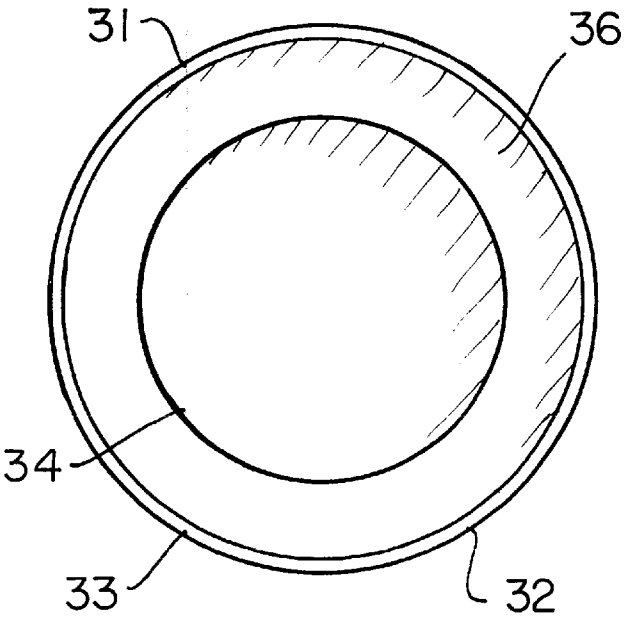
FIG. 5 is a top plan view of the present invention.

With reference now to the drawings, and in particular to FIGS. 1 through 6 thereof, a new paint bucket holder for a ladder embodying the principles and concepts of the present invention and generally designated by the reference numeral 10 will be described.

As best illustrated in FIGS. 1 through 6, the paint bucket holder for a ladder 10 generally comprises a clamping member 11 being adapted to securely fasten to a rail 47 of a ladder 46. The clamping member 11 includes a main wall 12, a first and second end walls 13,14 being conventionally attached and welded to ends of and extending perpendicularly from the main wall 12, and also includes a threaded member 15 being threaded through the first end wall 13, and further includes a plate-like member 16 having an edge 17 and being securely and conventionally attached to an end of the threaded member 15 and being movable toward and away from the second end wall 14 to securely fasten about the rail 47 of the ladder 46. The plate-like member 16 includes a flange member 18 extending from the edge 17 thereof and toward the second end wall 14 with the second end wall 14 including a flange member 19 extending from an edge thereof and toward the plate-like member 16.

The paint bucket holder for a ladder 10 also includes an arm member 20 having a first end 23 and a second end 24 which is securely and conventionally attached to the clamping member 11. The arm member 20 includes a first portion 22 and a second portion 21 which is angled relative to the first portion 22 with the second portion 21 being securely and conventionally attached to the main wall 12 of the clamping member 11.

An adjustable holder support member 24 is securely and conventionally attached and welded to the first end 23 of the arm member 20 and includes a housing 26 having a first cover member 27 and a second cover member 28 which is mirrored and fastened with a fastener 29 to the first cover member 27. Each of the cover members 27,28 includes a side wall 44, an end wall 40,41 and slot 42,43 extending through a portion of the end wall 40,41 and the side wall 44.

A bucket holder member 31 is movably mounted to the adjustable holder support member 25 with the bucket holder member 31 including an upper cylindrical portion 32 and a lower cylindrical portion 34 which has a circumference relatively smaller than that of the upper cylindrical portion 32. Each of the cylindrical portions 32,34 has a side wall 33,35. The bucket holder member 31 also includes an annular ledge 36 being securely disposed between the upper 32 and lower 34 cylindrical portions and being adapted to support a paint bucket. The bucket holder member 31 further includes a bottom wall 37 being securely and conventionally attached at a bottom of the lower cylindrical portion 34 and also includes a stem-like member 38 conventionally attached to and extending from the bottom wall 37 and having an end portion 39 which is movably and adjustably disposed within the housing 26. The annular ledge 36 is essentially attached to a bottom of the side wall 33 of the upper cylindrical portion 32 and to a top of the side wall 35 of the lower cylindrical portion 34. The end portion 39 of the stem-like member 38 is essentially shaped like that of the housing 26 and is relatively smaller than the housing 26. The end portion 39 of the stem-like member 38 is essentially disc-like and integrally extends outwardly on edge of the stem-like member 38. The disc-like end portion 39 of the stem-like member 38 is securely held within the housing 26 with a washer-like member 30 which is engageable to a side of the disc-like end portion 39.

In use, the user clamps the clamping member 11 about a portion of a rail 47 of the ladder 46 and adjusts the bucket holder member 31 so that it is essentially vertically disposed and then tightens the fastener 29 to the housing 26 to secure the disc-like end portion 39 of the stem-like member 38 within the housing 26. The user then places either a gallon or a quart of paint within at least one of the cylindrical portions 32,34 of the bucket holder member 31 so that the user has access to the paint while standing on the ladder 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint bucket holder for a ladder comprising:

a clamping member being adapted to securely fasten to a rail of a ladder;

an arm member having a first end and a second end which is securely attached to said clamping member;

an adjustable holder support member being securely attached to said first end of said arm member and including a housing; and a bucket holder member being movably mounted to said adjustable holder support member;

wherein said housing of said adjustable holder support member includes a first cover member and a second cover member, said second cover member being a substantial mirror image of said first cover member, a fastener fastening said first cover member and said second cover member together, an end portion of said bucket holder member extending between and being pivotally mounted on said first and second cover portions, each of said cover members having edges defining a portion of a slot, said edges limiting pivot movement of said bucket holder member with respect to said cover members.

2. A paint bucket holder for a ladder as described in claim 1, wherein said clamping member includes a main wall, a first and second end walls being attached to ends of and extending perpendicularly from said main wall, and also includes a threaded member being threaded through said first end wall, and further includes a plate member having an edge and being securely attached to an end of said threaded member and being movable toward and away from said second end wall to securely fasten about the rail of the ladder.

3. A paint bucket holder for a ladder as described in claim 2, wherein said plate member includes a flange member extending from said edge thereof and toward said second end wall.

4. A paint bucket holder for a ladder as described in claim 3, wherein said second end wall includes a flange member extending from an edge thereof and toward said plate member.

5. A paint bucket holder for a ladder as described in claim 1, wherein said arm member includes a first portion and a second portion which is angled relative to said first portion, said second portion being securely attached to said main wall of said clamping member.

6. A paint bucket holder for a ladder as described in claim 1, wherein said bucket holder member is limited to pivot about an angle of approximately 90 degrees with respect to said cover members.

7. A paint bucket holder for a ladder as described in claim 1, wherein said bucket holder member includes an upper cylindrical portion and a lower cylindrical portion which has a circumference relatively smaller than that of said upper cylindrical portion, each of said cylindrical portions having a side wall, said bucket holder member also including an annular ledge being disposed between said upper and lower cylindrical portions and being adapted to support a paint bucket, said bucket holder member further including a bottom wall being attached at a bottom of said lower cylindrical portion and also including a stem member extending from said bottom wall, said end portion forming a part of said stem member.

8. A paint bucket holder for a ladder as described in claim 7, wherein said annular ledge is attached to a bottom of said side wall of said upper cylindrical portion and to a top of said side wall of said lower cylindrical portion.

9. A paint bucket holder for a ladder as described in claim 7, wherein said end portion of said stem member is shaped like that of said housing and is relatively smaller than said housing.

10. A paint bucket holder for a ladder as described in claim 7, wherein said end portion of said stem member is substantially disc-shaped.

11. A paint bucket holder for a ladder as described in claim 10, wherein said disc-shaped end portion of said stem member is held in said housing with a washer member which is engageable to a side of said disc-shaped end portion.

12. A paint bucket holder for a ladder comprising:

a clamping member being adapted to securely fasten to a rail of a ladder, said clamping member including a main wall, a first and second end walls being attached to ends of and extending perpendicularly from said main wall, and also including a threaded member being threaded through said first end wall, and further including a plate-like member having an edge and being securely attached to an end of said threaded member and being movable toward and away from said second end wall to securely fasten about the rail of the ladder, said plate-like member including a flange member extending from said edge thereof and toward said second end wall, said second end wall including a flange member extending from an edge thereof and toward said plate-like member;

an arm member having a first end and a second end which is securely attached to said clamping member, said arm member including a first portion and a second portion which is angled relative to said first portion, said second portion being securely attached to said main wall of said clamping member;

an adjustable holder support member being securely attached to said first end of said arm member and including a housing, said housing of said adjustable holder support member including a first cover member and a second cover member which is mirrored and fastened with a fastener to said first cover member, each of said cover members including a side wall, an end wall and slot extending through a portion of said end wall and said side wall; and a bucket holder member being movably mounted to said adjustable holder support member, said bucket holder member including an upper cylindrical portion and a lower cylindrical portion which has a circumference relatively smaller than that of said upper cylindrical portion, each of said cylindrical portions having a side wall, said bucket holder member also including an annular ledge being securely disposed between said upper and lower cylindrical portions and being adapted to support a paint bucket, said bucket holder member further including a bottom wall being securely attached at a bottom of said lower cylindrical portion and also including a stem-like member extending from said bottom wall and having an end portion which is movably disposed within said housing, said annular ledge being essentially attached to a bottom of said side wall of said upper cylindrical portion and to a top of said side wall of said lower cylindrical portion, said end portion of said stem-like member being essentially shaped like that of said housing and is relatively smaller than said housing, said end portion of said stem-like member being essentially disc-like and extends outwardly on edge of said stem-like member, said disc-like end portion of said stem-like member being securely held within said housing with a washer-like member which is engageable to a side of said disc-like end portion.

13. A paint bucket holder for a ladder comprising:

a clamping member being adapted to securely fasten to a rail of a ladder;

an arm member having a first end and a second end which is securely attached to said clamping member;

an adjustable holder support member being securely attached to said first end of said arm member and including a housing; and a bucket holder member being movably mounted to said adjustable holder support member;

wherein said clamping member includes a main wall, a first and second end walls being attached to ends of and extending perpendicularly from said main wall, and also includes a threaded member being threaded through said first end wall, and further includes a plate-like member having an edge and being securely attached to an end of said threaded member and being movable toward and away from said second end wall to securely fasten about the rail of the ladder;

wherein said plate-like member includes a flange member extending from said edge thereof and toward said second end wall;

wherein said second end wall includes a flange member extending from an edge thereof and toward said plate-like member;

wherein said arm member includes a first portion and a second portion which is angled relative to said first portion, said second portion being securely attached to said main wall of said clamping member;

wherein said housing of said adjustable holder support member includes a first cover member and a second cover member which is mirrored and fastened with a fastener to said first cover member, each of said cover members including a side wall, an end wall and slot extending through a portion of said end wall and said side wall.

14. A paint bucket holder for a ladder as described in claim 13, wherein said bucket holder member includes an upper cylindrical portion and a lower cylindrical portion which has a circumference relatively smaller than that of said upper cylindrical portion, each of said cylindrical portions having a side wall, said bucket holder member also including an annular ledge being securely disposed between said upper and lower cylindrical portions and being adapted to support a paint bucket, said bucket holder member further including a bottom wall being securely attached at a bottom of said lower cylindrical portion and also including a stem-like member extending from said bottom wall and having an end portion which is movably disposed within said housing.

15. A paint bucket holder for a ladder as described in claim 14, wherein said annular ledge is essentially attached to a bottom of said side wall of said upper cylindrical portion and to a top of said side wall of said lower cylindrical portion.

16. A paint bucket holder for a ladder as described in claim 14, wherein said end portion of said stem-like member is essentially shaped like that of said housing and is relatively smaller than said housing.

17. A paint bucket holder for a ladder as described in claim 14, wherein said end portion of said stem-like member is essentially disc-like and extends outwardly on edge of said stem-like member.

18. A paint bucket holder for a ladder as described in claim 17, wherein said disc-like end portion of said stem-like member is securely held within said housing with a washer-like member which is engageable to a side of said disc-like end portion.

* * * * *